US010839626B2

(12) United States Patent
Spatig et al.

(10) Patent No.: US 10,839,626 B2
(45) Date of Patent: Nov. 17, 2020

(54) DYNAMIC KEY ACCESS CONTROL SYSTEMS, METHODS, AND APPARATUS

(71) Applicant: Southco, Inc., Concordville, PA (US)

(72) Inventors: Stephen Keith Spatig, West Chester, PA (US); Son Van Ngo, Philadelphia, PA (US)

(73) Assignee: SOUTHCO, INC., Concordville, PA (US)

( * ) Notice: Subject to any disclaimer, the term of this patent is extended or adjusted under 35 U.S.C. 154(b) by 0 days.

(21) Appl. No.: 16/301,492

(22) PCT Filed: May 16, 2017

(86) PCT No.: PCT/US2017/032874
§ 371 (c)(1),
(2) Date: Nov. 14, 2018

(87) PCT Pub. No.: WO2017/201029
PCT Pub. Date: Nov. 23, 2017

(65) Prior Publication Data

US 2019/0221062 A1 Jul. 18, 2019

Related U.S. Application Data

(60) Provisional application No. 62/339,304, filed on May 20, 2016.

(51) Int. Cl.
*G07C 9/00* (2020.01)
*G07C 9/20* (2020.01)

(52) U.S. Cl.
CPC ..... *G07C 9/00309* (2013.01); *G07C 9/00571* (2013.01); *G07C 9/00857* (2013.01); *G07C 9/20* (2020.01); *G07C 2009/00388* (2013.01); *G07C 2009/00436* (2013.01); *G07C 2009/00523* (2013.01); *G07C 2009/00769* (2013.01);
(Continued)

(58) Field of Classification Search
None
See application file for complete search history.

(56) References Cited

U.S. PATENT DOCUMENTS 7,536,709 B2 5/2009 Shitano
7,706,778 B2 4/2010 Lowe
(Continued)

FOREIGN PATENT DOCUMENTS

CN 103261551 A 8/2013
EP 2650458 A1 10/2013

OTHER PUBLICATIONS

International Preliminary Report on Patentability and Written Opinion issued in PCT International Application No. PCT/US2017/032874, dated Nov. 20, 2018, 12 pages.
(Continued)

*Primary Examiner* — Carlos Garcia
(74) *Attorney, Agent, or Firm* — RatnerPrestia

(57) ABSTRACT

Methods and systems for controlling electro-mechanical (EM) latches. An EM latch may be controlled by receiving dynamic key information from a smart device and static access card information from an access card. A signal generator sends a signal to actuate the EM latch upon verification of the dynamic key information or static access card information. The smart device may be associated with a single user or with multiple users.

16 Claims, 4 Drawing Sheets

(52) U.S. Cl.
CPC ..... *G07C 2009/00825* (2013.01); *G07C 2009/00865* (2013.01)

(56) References Cited

U.S. PATENT DOCUMENTS

| | | | | |
|---|---|---|---|---|
| 8,496,275 | B2 | 7/2013 | Garneau et al. | |
| 8,706,083 | B2 | 4/2014 | Willis | |
| 8,768,565 | B2 * | 7/2014 | Jefferies | G07B 15/00 701/32.7 |
| 8,881,252 | B2 | 11/2014 | Van Till et al. | |
| 2008/0269990 | A1 * | 10/2008 | Ghannam | B60R 21/0134 701/45 |
| 2009/0170479 | A1 * | 7/2009 | Jarenskog | H04M 1/72572 455/414.1 |
| 2011/0311052 | A1 * | 12/2011 | Myers | G07C 9/00103 380/270 |
| 2013/0150017 | A1 * | 6/2013 | Gold | H04W 8/245 455/419 |
| 2014/0051407 | A1 | 2/2014 | Ahearn et al. | |
| 2015/0199863 | A1 * | 7/2015 | Scoggins | G07C 9/00904 340/5.25 |
| 2015/0284984 | A1 * | 10/2015 | Kanter | E05F 15/76 49/31 |
| 2016/0012411 | A1 * | 1/2016 | Kursun | G06Q 20/3221 705/42 |
| 2016/0130840 | A1 | 5/2016 | Garneau | |
| 2017/0334395 | A1 * | 11/2017 | Lu | B60R 25/24 |
| 2018/0039987 | A1 * | 2/2018 | Molino | G06Q 20/34 |
| 2019/0026456 | A1 * | 1/2019 | Hon | G06F 21/31 |

OTHER PUBLICATIONS

International Search Report issued in PCT/US2017/032874, dated Oct. 10, 2017, 5 pages.
Written Opinion of the International Search Authority issued in PCT/US2017/032874, dated Oct. 10, 2017, 10 pages.
Chinese Office Action for Chinese Application No. 201780031246.7, dated Sep. 22, 2020 with translation, 32 pages.

* cited by examiner

DYNAMIC KEY ACCESS CONTROL SYSTEMS, METHODS, AND APPARATUS

CROSS REFERENCE TO RELATED APPLICATIONS

This application is the U.S. National Phase Application of PCT/US2017/032874, filed May 16, 2017 which claims the benefit of priority to U.S. Provisional Application No. 62/339,304, entitled DYNAMIC KEY ACCESS CONTROL, SYSTEMS, METHODS, AND APPARATUS, filed on 20 May 2016, the contents of such applications being incorporated by reference herein.

FIELD OF THE INVENTION

The invention relates to controlled access of physical enclosures and, more particularly, to methods, systems, and apparatus for controlling access using dynamic keys.

BACKGROUND OF THE INVENTION

Wireless access control systems may be installed to provide access to an enclosure. For example, an access control system may be installed at an entry door to prevent access to a room or at a locker door to prevent access to a locker. The wireless access control system may include a reader for receiving and verifying access information such as a code and an electro-mechanical latch that is actuated by the reader to gain access to the enclosure.

The use of readers and electro-mechanical latches may create security concerns. For example, the reader may be vulnerable to interference or attack.

SUMMARY OF THE INVENTION

The invention is embodied in a controller and method for controlling an electro-mechanical (EM) latch. An EM latch may be controlled by receiving dynamic key information from a smart device, receiving static access card information from an access card, verifying the dynamic key information, when received, and instructing a signal generator to actuate the EM latch when the dynamic key information is verified, and verifying the static access card information, when received, by comparing the received static access card information to stored access card information and instructing the signal generator to actuate the EM latch when the received static access card information matches the stored access card information.

The invention is also embodied in methods and systems for controlling access. Access may be controlled by receiving input from a first user indicative of the first user at a multi-user smart device, storing an identifier in a memory corresponding to the input indicative of the first user, receiving dynamic key information, verifying the dynamic key information, instructing a signal generator to actuate an electro-mechanical (EM) latch when the dynamic key information is verified, associating the identifier with the EM latch actuation, and notifying an administrator of the EM latch actuation and the associated identifier corresponding to the input indicative of the first user.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. The letter "n" may represent a non-specific number of elements. Also, lines without arrows connecting components may represent a bi-directional exchange between these components. This emphasizes that according to common practice, the various features of the drawings are not drawn to scale. On the contrary, the dimensions of the various features are arbitrarily expanded or reduced for clarity. Included in the drawings are the following figures.

DETAILED DESCRIPTION OF THE INVENTION

Figure 1:
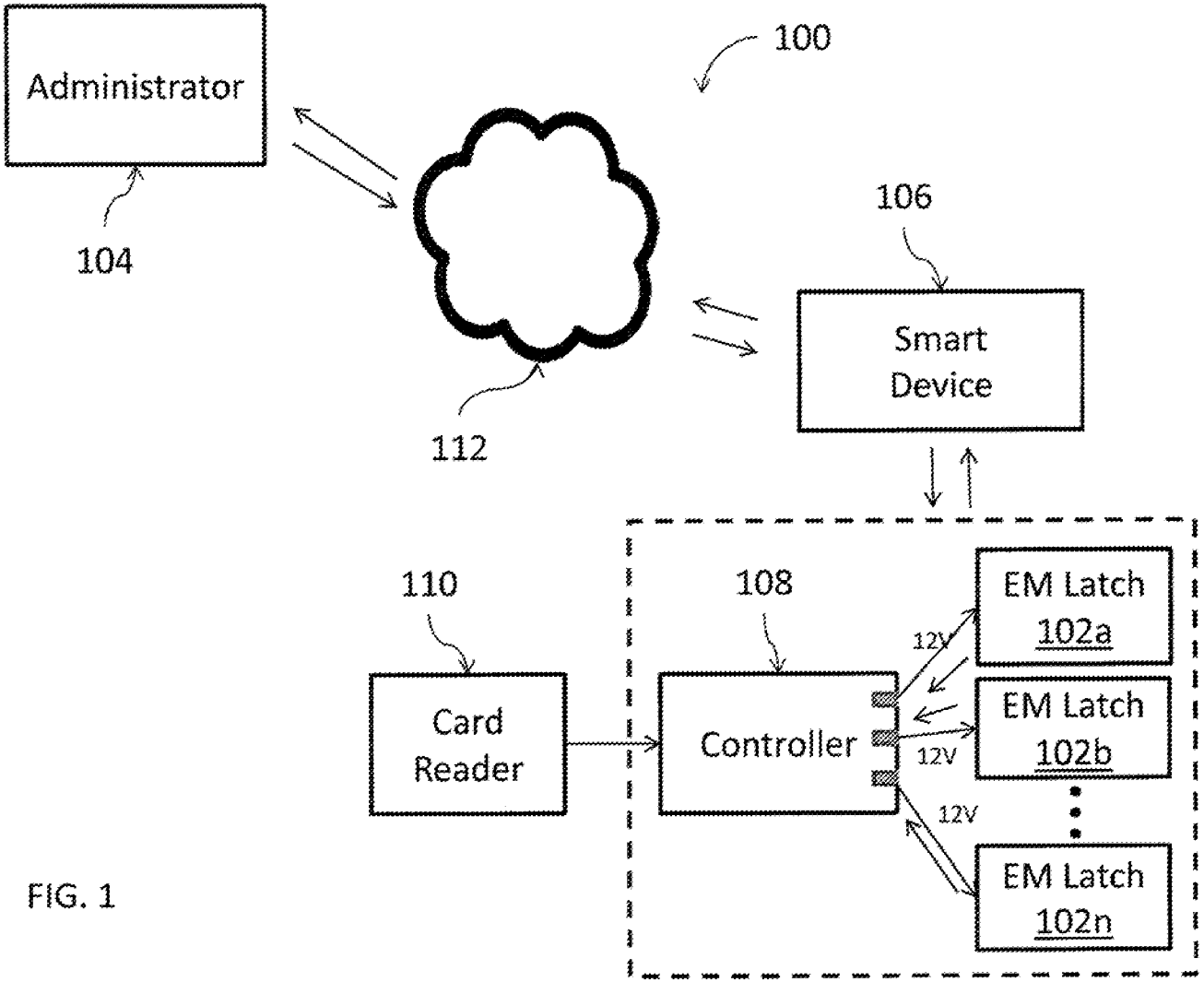
FIG. 1 is a block diagram of a system for actuating an electro-mechanical (EM) latch in accordance with aspects of the invention.

FIG. 1 depicts a system 100 for actuating one or more electro-mechanical (EM) latches 102*a-n*. The illustrated system 100 includes an administrator 104, a smart device 106, a controller 108, and multiple EM latches 102. In an embodiment, administrator 104 is a server that dynamically generates electronic keys (keys) for use by a user of the smart device 106 to gain access to enclosures secured with the EM latches 102. The illustrated system additionally includes a card reader 110 that, when included, enables the system to unlock the EM latches 102 using access cards (e.g., magnetic swipe, RFID, Wiegand-based cards, etc.).

Accordingly, and as will be described in greater detail below, one aspect of the invention includes the combination of (1) an access system, such as for example a Wiegand-based card reader system, that is configured to communicate and provide information such as an access audit trail (optionally via Bluetooth) to an administrator with (2) a multi-user control smart device, such as a dedicated tablet, that is configured to communicate and provide information such as an access audit trail (optionally via Bluetooth) to the administrator via a security key, such as by providing a dynamic key.

Also, the invention can include retrofitting an existing access system (e.g., legacy equipment in the form of an access card system) by configuring it to communicate information such as an access audit trail to an administrator and by combining the existing access system with a multi-user control smart device that is configured to communicate with the administrator via a security key.

In a general system overview of an embodiment such as the one illustrated in FIG. 1, administrator 104 generates dynamic keys for use in actuating an EM latch 102. A dynamic key is periodically sent by administrator 104 to a smart device 106 along with meta data related to the dynamic key. Smart device 106 supplies the key and the meta data to controller 108, e.g., in response to a selection of the key by a user of smart device 106. The controller 108 validates the key, e.g., by independently generating a corresponding key using the meta data (and other information such as a smart device identifier and the time) and comparing the two keys, and sends an actuation signal (e.g., a 12 volt signal) to an EM latch 102 upon validation. The EM latch 102 is actuated (e.g., opened) in response to the actuation signal, thereby allowing access to an enclosure secured by the EM latch 102. EM latch 102 may provide details such as time of lock/unlock, lock status (e.g., locked/unlocked) and/or enclosure/door status (e.g., open/closed). Controller 108 communicates status information via smart device 106 to administrator 104 to create an audit trail.

Details regarding the generation of dynamic keys in accordance with aspects of the invention are described in U.S. Pat. No. 8,706,083 to Willis titled BLUETOOTH AUTHENTICATION SYSTEM AND METHOD. Additional details regarding implementations of dynamic keys that can be used with the invention are described in U.S. Pat. No. 7,706,778 to Lowe titled SYSTEM AND METHOD FOR REMOTELY ASSIGNING AND REVOKING ACCESS CREDENTIALS USING A NEAR FIELD COMMUNICATION EQUIPPED PHONE, U.S. Pat. No. 7,536,709 to Shitano titled ACCESS CONTROL APPARATUS, and U.S. Pat. No. 8,881,252 to Van Till et al. titled SYSTEM AND METHOD FOR PHYSICAL ACCESS CONTROL, which are incorporated fully herein by reference.

Various cloud-based access control systems (both enterprise and consumer-based systems) can optionally be used in this invention. For example, the access control system optionally incorporates cloud features, mobile features, and/or dynamic pins. The dynamic pin is optionally employed as an authentication to enhance security that can, for example, allow authorized personnel to use smart devices such as smartphones to access locked spaces such as by using a Bluetooth connection. Accordingly, Bluetooth-enabled locks and mobile key software are optionally employed, as discussed previously.

Details regarding an example of an EM latch that can be used in accordance with aspects of the invention are described in U.S. patent application Ser. No. 14/535,790 to Garneau titled CAM LATCH (now published as US 2016-0130840 A1), and U.S. Pat. No. 8,496,275 to Garneau titled ROTARY PAWL LATCH, which are incorporated fully herein by reference.

Additionally, card reader 110 may be used to retrieve card access information from access cards (not shown). Access card reader 110 may be configured to read card access information from conventional access cards such as one or more of magnetic swipe, 125 kHz Prox, MiFare, iClass, Smartcard, or RFID access card. Controller 108 matches the card access information to previously stored card access information (which may be received via a smart device 106) and supplies the actuation signal (e.g., a 12 volt signal) to the EM latch 102 upon a match. Controller 108 communicates status information via smart device 106 to administrator 104 to create an audit trail for card reader access. The status information may be stored by the controller until the next smart card device 104 is within range. This enables an audit trail to be established for RFID card reader access without requiring conventional hard-wired systems.

Administrator 104 may be accessed remotely by a device such as a personal computer having an Internet connection and appropriate credentials. Once access to administrator 104 is gained, dynamic key parameters can be configured (set, revoked, changed) and audit trail information (e.g., for both dynamic key access and RFID card access) can be obtained.

Controller 108 and EM latch 102 may each be a standalone device. Alternatively, EM latch 102 may be incorporated into the same housing as controller 108 with the housing of controller 108 supporting, directly or indirectly, EM latch 102. Likewise, card reader 110 may be a standalone device or incorporated into controller 108.

Figure 1B:
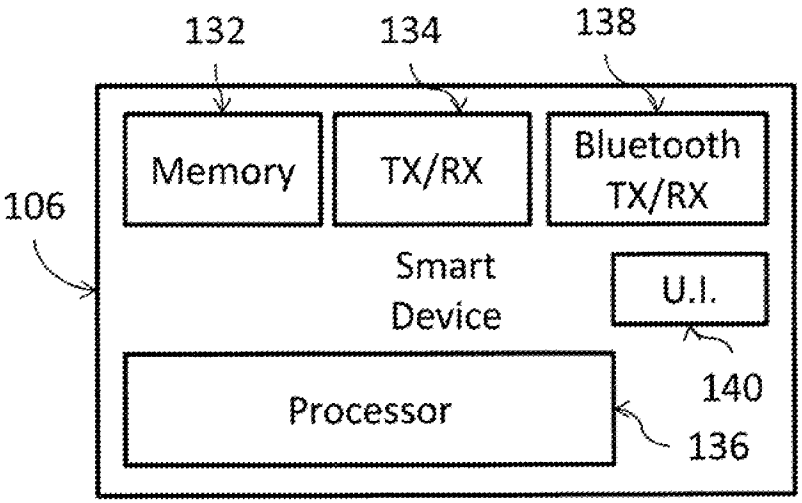
FIGS. 1A, 1B, and 1C are block diagrams of components of the system of FIG. 1 in accordance with aspects of the invention.
Figure 1A:
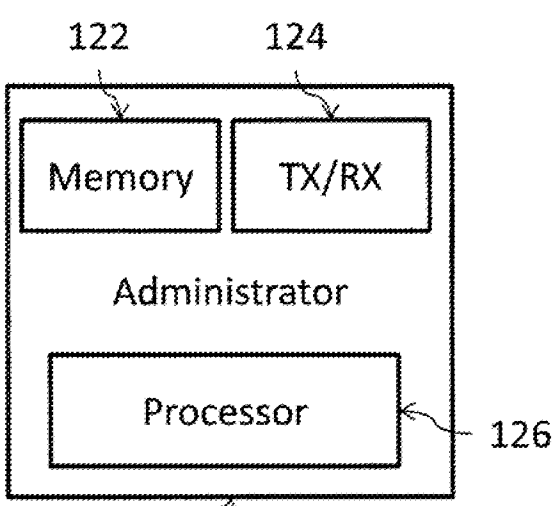

FIG. 1A depicts an embodiment of an administrator 104. The illustrated administrator 104 includes a memory 122, a transceiver 124, and a processor 126. Memory 122 stores instructions for execution by processor 126 to provide functionality of administrator 104. Memory 122 may also store audit trail information received from controller 108 via smart device 106. Transceiver 124 communicates with smart device 106 using one or more communication mediums, e.g., cellular, WiFi, the Internet and/or other communication medium. Administrator 104 may be implemented using conventional computer equipment or equipment of a cloud based access control system such as Salesforce.com provided by Salesforce.com, Inc. of San Francisco, Calif.

The administrator 104 is configured to register users, set up user credentials, communicate with the smart device 106, dynamically generate keys, and distribute the keys along with meta data describing the keys to the smart device automatically (e.g., periodically at a specified interval) and/or in response to requests received from the smart device 106. Each key may be generated using a secure algorithm that combines, for example, identification information for the smart device 106, a controller 108 or group of controllers, and a dynamic parameter such as time. The administrator 104 may communicate with the smart device 106 over a network computer system 112 and may be hosted by a hosting service such as Salesforce.com. The network computer system 112 may include one or more of the Internet, cellular communication system, WiFi, and/or other communication mediums through which mobile devices may communicate.

During a registration process, administrator 104 receives profile information from smart device 106 (or smart device 206; discussed below) for the user. The profile information includes user identification information (e.g., phone number, first name, last name, email address, and pseudo ID. The pseudo ID may be generated by a mobile application, such as the Vizpin mobile application available from Vizpin of Lancaster, Pa., during registration. The administrator 104 may "push" keys to the smart devices 106 periodically. Thus, the administrator may automatically initiate a system update involving generating and transmitting a new key to a smart device 106. In one embodiment, a smart device 106 may request a current key prior to the administrator pushing out the next key, e.g., in the event the smart device 106 was unavailable when the administrator issued the last key.

User credentials may be established at the administrator 104 to regulate with keys are "pushed" to the smart devices. User credentials may include identification information for the controller(s) 108 a particular user is able to access, a schedule for the particular user for each of these controllers 108, and identification information for a smart device 106 associated with the particular user. The schedule may include a start and end date/time, an access time period, and a roll-over period. The access time period is an authorized time period for access such as, for example, 9 am to 5 pm, Monday through Friday. The roll-over period indicates when each Key is to expire, e.g., every 4 hours. The start and end date/time indicate when the user will be granted keys according to the schedule defined by the access period. Controller identification information, the access time period, end date/time and the time this key will expire may be included in meta data distributed by the administrator 104 along with the keys.

FIG. 1B depicts an embodiment of a smart device 106. The illustrated smart device 106 includes a memory 132, a transceiver 134, a processor 136, a Bluetooth transceiver 138, and a user interface 140. Memory 132 stores instructions for execution by processor 136 to provide functionality of smart device 106. Memory 132 may store key and meta data received from administrator 102. Additionally, audit trail information may be stored temporarily in memory 132 for transfer between the smart device 106 and the administrator.

Transceiver 134 is configured for communication with transceiver 124 of administrator 102. Bluetooth® transceiver 138 may be used to communicated with controller 108. Bluetooth® transceiver 138 may communicate using conventional Bluetooth®, Bluetooth® Low Energy (BTLE), and/or in accordance with another Bluetooth® standard. Although a Bluetooth® transceiver 138 is illustrated and described for communication with controller 108, it is contemplated that other types of communication medium such at NFC or WiFi may be employed. User interface 140 may be a touch screen, buttons, etc. for presenting information to a user (e.g., key selection options) and receiving input from a user (e.g., selection of a particular key). Smart device 106 may be implemented using components of a mobile device such as an iPhone available from Apple, Inc. of Cupertino, Calif.

Smart device 106 may be configured to register a user with the administrator 104, receive new keys, process meta data received with new keys, and present non-expired keys within an authorized time period to controller 108 upon selection by a user. Smart device 106 may be configured to initiate a request for a key refresh without the need to wait for the administrator to "push" a new key at the next interval. Smart device 106 may process the meta data received with each key to determine which controller 108 the key is configured to access, the authorized time period, and when the key is scheduled to expire based on a roll over period. Smart device 106 may be password protected.

In one embodiment, controller 108 broadcasts an advertisement that contains the identity of controller 108 in plain text plus encrypted data used to secure any resulting transaction. Smart device 106 compares the identification information received from the controller 108 with identification information contained in the meta data and visually indicates when a controller is in range by, for example, highlighting the key (e.g., by default greying out keys not within range). In an alternative embodiment, the smart device 106 relies on the user to determine when it's appropriate to use a key.

The smart device 106 may additionally make a determination regarding the status of the keys and visually indicate this status on the smart device 106 for viewing by the user. Non-expired keys within an authorized time period may have a green indicator, non-expired keys outside the authorized time period may have a yellow indicator, and expired keys may have a red indicator.

Figure 1C:
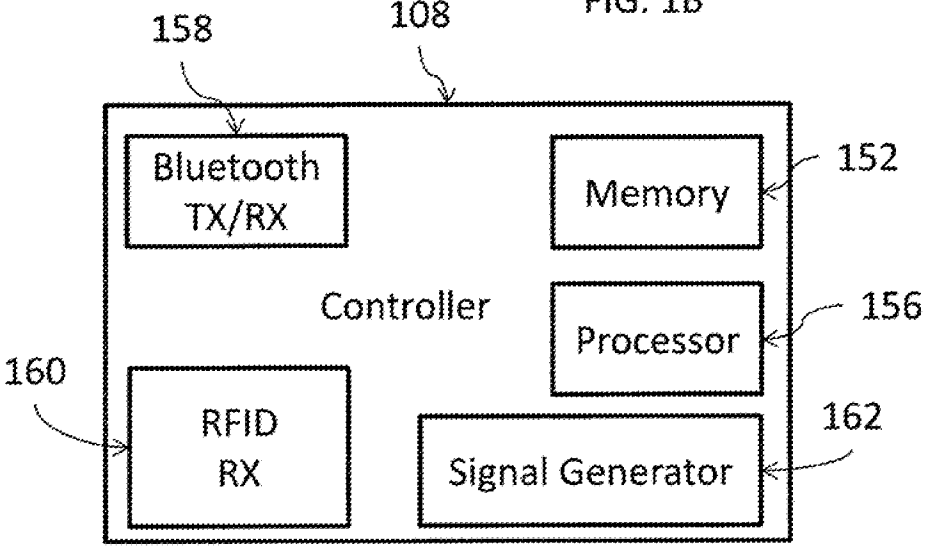

FIG. 1C depicts an embodiment of a controller 108. The illustrated controller 108 includes a memory 152, a processor 156, a Bluetooth transceiver 158, a receiver 160, and a signal generator 162. Memory 152 stores instructions for execution by processor 156 to provide functionality of controller 108. Memory 152 may store algorithms for independently generating corresponding dynamic keys for meta data and other parameters. Memory 152 may also store audit trail information associated with an access card for transmission when a smart device 106 is within communication distance of controller 108. Memory 152 is sized to hold access card information for multiple access cards (e.g., 1000 or more) plus audit trail information (e.g., 2,500 or more transactions). Bluetooth® transceiver 158 is configured for communication with Bluetooth® transceiver 138 of smart device 106. Although a Bluetooth® transceiver 158 is illustrated and described for communication with smart device 106, it is contemplated that other types of communication medium such at NFC or WiFi may be employed. RFID receiver 160 is receive access card information from RFID cards, e.g., magnetic swipe, Wiegand based reader, etc. RFID receiver 160 may be a RFID card reader incorporated into controller 108. Alternatively, RFID receiver 160 may be a receiver configured to receive card access information from a separate RFID card reader.

In an embodiment for dynamic key operation, controller 108 is configured to receive a key or key derivative from smart device 106 along with identification information for the smart device 106. Controller 108 generates a verification key using a proprietary algorithm based on its own identity, the identification information for the smart device, and the current time. Controller 108 then validates the received key or derivative key by comparing it with the generated verification key, and signals the EM latch 102 to open, e.g., by providing a 12V DC signal from signal generator 162 under control of processor 156, when there is a match.

In an embodiment for RFID card operation, controller 108 is configured to receive card access information from an access card. Controller 108 compares the received card access information to access card information stored in memory 152, and signals the EM latch 102 to open, e.g., by providing a 12V DC signal from signal generator 162 under control of processor 156, when there is a match. For RFID card operation, controller 108 may be configured to accept 125 kHz proxy and 13.56 MHz RFID credentials.

Controller 108 additionally communicates to smart device 106 via Bluetooth® transceivers 138, 158 after there is a match (indicating that the user has unlocked the enclosure secured by the EM latch 102), which is, in turn, communicated to the administrator 104. The communication may be immediate, e.g., in the case of a dynamic key operation or may be at a later time for a RFID card operation (e.g., when a smart device 106 is within range. Controller 108 additionally records access activity in a non-volatile memory, which can be retrieved by physically going to the controller and retrieving the stored information from the memory.

EM latch 102 is an electro mechanical latch that is actuated by the controller 108. EM latch 102 is actuated when it receives an appropriate signal from the controller. In an embodiment, the signal is a 12 volt signal. In accordance with this embodiment, when the controller 108 applies a 12 volt signal to the EM latch 102 the EM latch opens and when the controller 108 stops supplying the 12 volt signal the EM latch closes. The EM latch 102 may be separate from the controller or may be incorporated into the controller. In embodiments where the EM latch 102 is incorporated into the controller, the housing of the controller may directly or indirectly support the EM latch 102. A suitable latch is described in U.S. Pat. No. 8,496,275 to Garneau et al., titled ROTARY PAWL LATCH, the contents of which are incorporated fully herein by reference.

The components of system 100 are described herein primarily in conjunction with one EM latch 102. Controller 108 may additionally be configured with multiple ports for actuating multiple latches 102 corresponding to those multiple ports. In an embodiment, the meta data supplied with a particular key identifies one or more of the ports (and, thus, one or more of the corresponding EM Latches) to be actuated by that particular key. For example, a first EM latch 102*a* may be associated with a front panel of a server contained within a server rack, a second EM latch 102*b* may be associated with a back panel of a server, and a third EM latch 102*c* may be associated with a release lever for the server. In accordance with this embodiment, a key may be provided with meta data indicating it is for access to the first and second EM latches 102*a, b*. In this case, the user supplying the key via smart device 106 could access the front and back of the server upon validation of the key by the controller 108, but could not remove the server from the rack.

Figure 2:
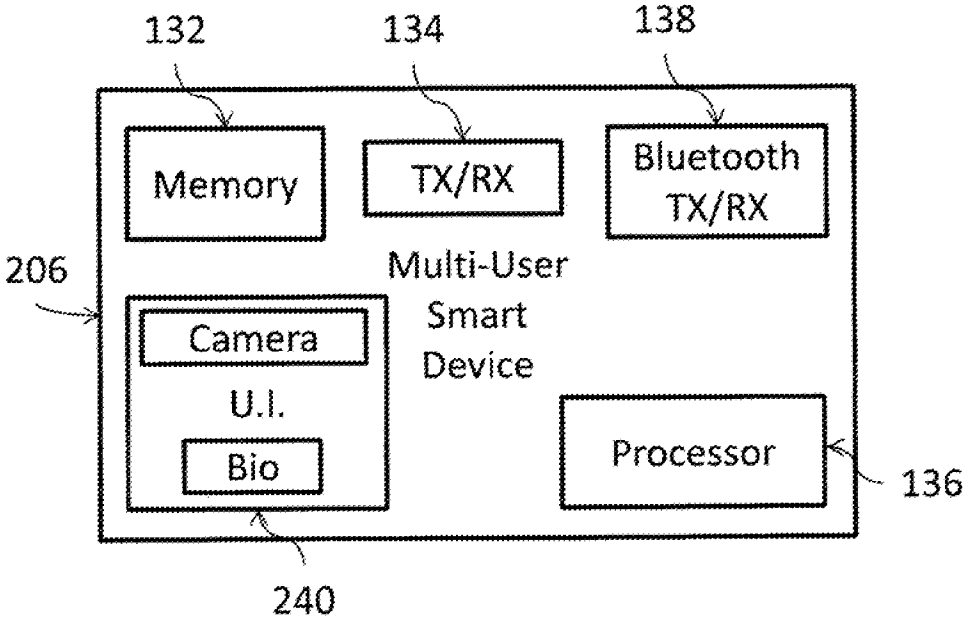
FIG. 2 is a block diagram of an alternative smart device for use in the system of FIG. 1 in accordance with aspects of the invention.

FIG. 2 depicts an alternative smart device 206 for use in system 100. Smart device 206 is a shared smart device designed for multi-user access. Similar components to those found in smart device 106 have the same reference number and are described above. Smart device 206 may be configured to wake on touch and includes an enhanced user interface 240. The user interface 240 includes a camera and/or bio sensor (e.g., fingerprint sensor). Smart device 206 may be implemented using components of a device such as an iPad available from Apple, Inc. of Cupertino, Calif. Users may utilize user interface 240 to request access to an enclosure secured by an EM latch 102.

Smart device 206 may include a supervisor mode and a user mode. In supervisor mode, user profiles may be created, deleted, and/or modified and/or user credentials may be created, deleted, and/or modified. A supervisor, using smart device 206 in supervisor mode, creates new user profiles, which are sent to the administrator 104. Each new user profile includes user identification information (e.g., first name, last name, email address, unique personal identification number (PIN), bio template, etc.). Additionally, smart device 206 sends smart device information such as its Bluetooth® mac address or another identifier that is unique to smart device 206 to administrator 104.

In user mode, the user may enter a personal identification number PIN associated with the user to view authorized key(s) for that user. The user may then select an authorized key to access a corresponding EM latch. Additionally, the smart device 206 may capture user information such as an image of the user via a camera and/or a biological identifier such as a fingerprint or retinal scan via a biological sensor.

Administrator 104 periodically generates and sends dynamic keys and associated meta data to smart device 206 for registered users to access the EM latches associated with the smart device 206. Upon selection of an available keys smart device 206 communicates the selected key and associated meta data to controller 108, which actuates EM latch 102 as described above. Audit trail data is stored by controller 108 and sent to administrator 104 via smart device 206.

Figure 3:
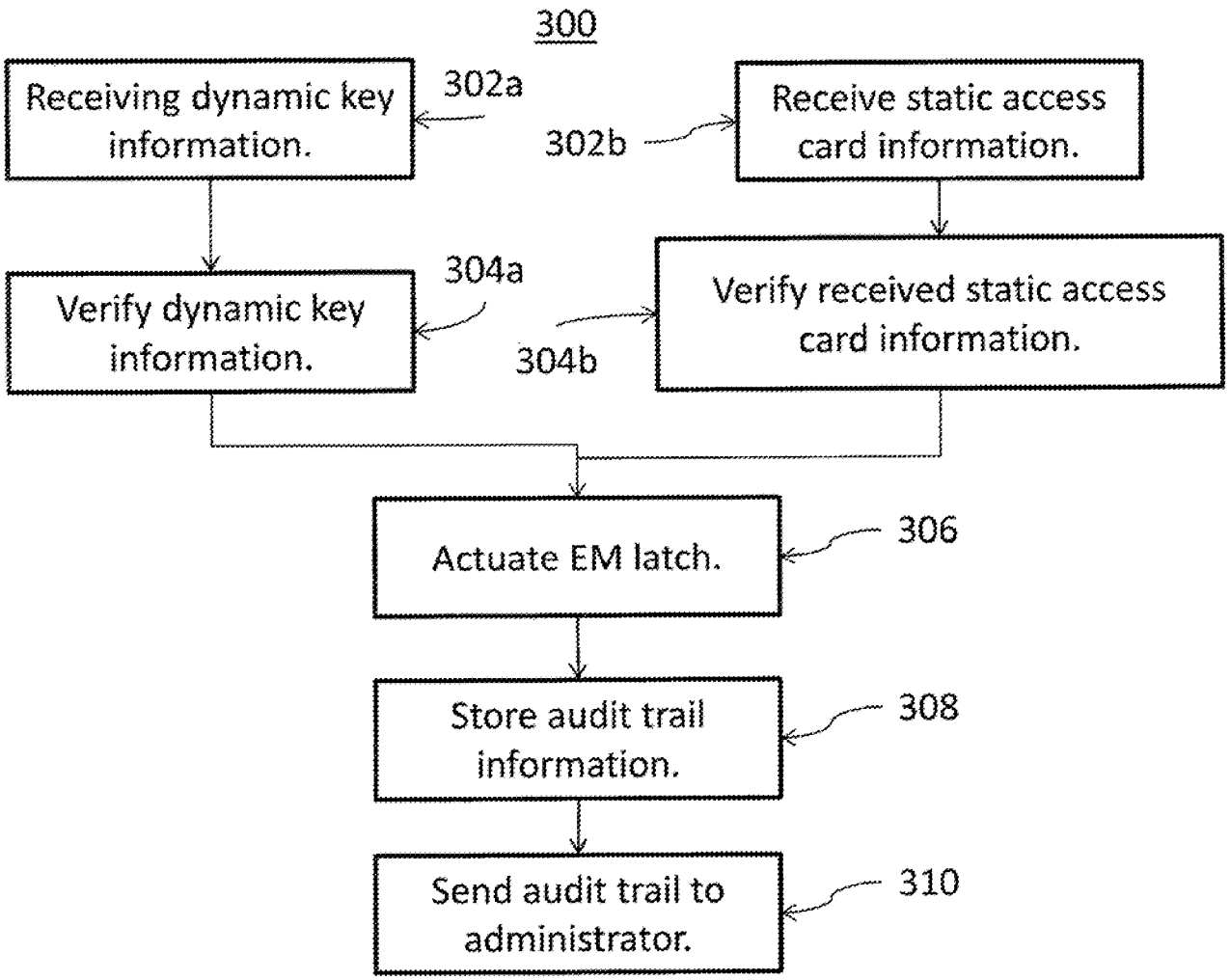
FIG. 3 is a method for actuating a EM latch in accordance with aspects of the invention.

FIG. 3 depicts a method 300 for controlling an EM latch in accordance with aspects of the invention. The method is described with reference to the system 100 described above; however, the method has applicability with other systems. One or more of the steps depicted in FIG. 3 may be performed in a different order or omitted, and steps may be added, without departing from the scope of the invention.

At block 302*a*, dynamic key information is received. Dynamic key information (including a dynamic key and meta data) may be received from administrator 104 via smart device 106. Administrator 104 may periodically send/push new keys (e.g., every four hours) for receipt by smart device 106, 206. Smart device 106, 206 may pass information from administrator 104 through smart device (automatically or in response to input from the user) for receipt by controller 108.

At block 302*b*, static access card information is received. Static access card information may be received from an access card via card reader 110 at controller 108.

At block 304*a*, dynamic key information is verified. Controller 108 may verify dynamic key information. Controller 108 may generate a verification key based on the meta data for verification of the dynamic key.

At block 304*b*, static access card information is verified. Controller 108 may verify static access card information by comparing the access card information to previously stored access card information in memory 152. Previously stored access card information may be received from administrator 104 via smart device 106*j* and stored by processor 156 in memory 152.

At block 306, an EM latch is actuated. Upon verification of the dynamic key information or the static access card information by controller 108, the controller generates a signal to actuate EM latch 102.

At block 308, audit trail information is stored. Controller 108 may store audit trail information. Audit trail information includes one or more of the time of actuation, time door open, time door closed, time latch open, or time latch closed.

At block 310, audit trail information is sent to the administrator. Audit trail information may be conveyed to the administrator 104 by the smart device 106. Smart device 106 may collect audit trail data from one or more transactions (dynamic and/or static key transaction information) when smart device 106 is within communication distance of controller 108. Smart device 106 may store collected audit trail data for communication to administrator 104 when smart device 106 is able to establish communication with administrator 104.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A method for controlling an electro-mechanical (EM) latch, the method comprising the steps of:

receiving dynamic key information from a smart device, the smart device includes:

a supervisor mode in which a supervisor uses the smart device to create, delete, or modify user profiles or user credentials, and a user mode in which multiple users each use the smart device to enter a respective personal identification number or the smart device captures respective user information, and the smart device selects an authorized key to actuate the EM latch when the user is determined to be authorized based on the personal identification number or the captured user information;

receiving static access card information from an access card;

verifying the dynamic key information, when received, and instructing a signal generator to actuate the EM latch when the dynamic key information is verified; and verifying the static access card information, when received, by comparing the received static access card information to stored access card information and instructing the signal generator to actuate the EM latch when the received static access card information matches the stored access card information.

2. The method of claim 1, further comprising:

receiving new static access card information;

storing the new static access card information in a memory;

matching the received static access card information to the stored new access card information; and instructing the signal generator to actuate the EM latch when the received static access card information matches the stored new access card information.

3. The method of claim 1, further comprising:

determining which of the EM latch or at least one other EM latch to actuate based on the received static access card information or the dynamic key information;

wherein the instructing a signal generator to actuate the EM latch when the dynamic key information is verified step and instructing the signal generator to actuate the EM latch when the received static access card information matches the stored access card information step are based on the determined EM latch or at least one other EM latch.

4. The method of claim 1, further comprising:

storing audit trail information corresponding to the received static access card information; and sending the stored audit trail to an administrator via the smart device.

5. The method of claim 1, further comprising:

generating, by a server, the dynamic key information;

sending, by the server, the dynamic key information to the smart device;

forwarding, by the smart device, the dynamic key information to a controller of the EM latch; and verifying, by the controller, the dynamic key information by generating a verification key and comparing the verification key to the dynamic key.

6. The method of claim 1, further comprising:

indicating, by the smart device, that the smart device is within a range of the EM latch for actuating the EM latch.

7. The method of claim 1, further comprising:

displaying, by the smart device, that the dynamic key information is verified for actuating the EM latch.

8. The method of claim 1, further comprising:

instructing, by the smart device, the signal generator to actuate at least one other EM latch, wherein the EM latch and the at least one other EM latch are independently controllable by the signal generator.

9. A system for controlling access, the system comprising:

an electro-mechanical (EM) latch;

a multi-user smart device configured to convey dynamic key information, the multi-user smart device comprising:

a user interface configured to receive input indicative of a particular user;

a memory configured to store information; and a processor coupled to the user interface and the memory, the processor configured to receive the input indicative of the particular user and store an identifier in the memory corresponding to the input indicative of the particular user, wherein the multi-user smart device further comprises:

a supervisor mode in which a supervisor uses the multi-user smart device to create, delete, or modify user profiles or user credentials, and a user mode in which multiple users each use the multi-user smart device to enter a respective personal identification number or the multi-user smart device captures respective user information, and the multi-user smart device selects an authorized key to actuate the EM latch when the particular user is determined to be authorized based on the personal identification number or the captured user information; and a controller coupled for communication with the EM latch and the multi-user smart device, the controller comprising:

a wireless transceiver configured to communicate with the multi-user smart device;

a signal generator configured to actuate the EM latch; and a processor coupled to the wireless transceiver and the signal generator, the processor configured to receive the dynamic key information via the wireless transceiver, verify the dynamic key information, and instruct the signal generator to actuate the EM latch when the dynamic key information is verified.

10. The system of claim 9, further comprising:

a housing at least partially supporting the wireless transceiver, the signal generator, the processor, and the EM latch.

11. The system of claim 9, further comprising:

a biosensor coupled to the user interface.

12. The system of claim 9, further comprising:

a camera coupled to the user interface.

13. A method for controlling access, the method comprising the steps of:

receiving input from a first user indicative of the first user at a multi-user smart device, the multi-user smart device further comprises:

a supervisor mode in which a supervisor uses the multi-user smart device to create, delete, or modify user profiles or user credentials, and a user mode in which multiple users each use the multi-user smart device to enter a respective personal identification number or the multi-user smart device captures respective user information, and the multi-user smart device selects an authorized key to actuate an electro-mechanical (EM) latch when the first user is determined to be authorized based on the personal identification number or the captured user information;

storing an identifier in a memory corresponding to the input indicative of the first user;

receiving dynamic key information;

verifying the dynamic key information;

instructing a signal generator to actuate the EM latch when the dynamic key information is verified;

associating the identifier with the EM latch actuation; and notifying an administrator of the EM latch actuation and the associated identifier corresponding to the input indicative of the first user.

14. The method of claim 13, further comprising:

determining which of the EM latch or at least one other EM latch to actuate based on the received dynamic key information;

wherein the instructing the signal generator to actuate the EM latch when the dynamic key information is verified step is based on the determined EM latch or at least one other EM latch.

15. The method of claim 13, further comprising:

capturing an image of the first user;

associating the image with the EM latch actuation; and sending the image to the administrator.

16. The method of claim 13, further comprising:

capturing a biological identifier of the first user;

associating the biological identifier with the EM latch actuation; and sending the biological identifier to the administrator.

* * * * *